United States Patent [19]

Bricmont

[11] Patent Number: 4,829,753

[45] Date of Patent: May 16, 1989

[54] APPARATUS FOR WRAPPING OVERLAPPING LAPS OF STRIP MATERIAL OVER A CYLINDRICAL OBJECT HAVING AN AXIAL OPENING THEREIN

[76] Inventor: Francis H. Bricmont, 395 Valley Brook Rd., McMurray, Pa. 15137

[21] Appl. No.: 144,106

[22] Filed: Jan. 15, 1988

[51] Int. Cl.[4] ..... B65B 13/04

[52] U.S. Cl. ..... 53/588; 53/204; 100/12; 242/4 B

[58] Field of Search ..... 53/587, 588, 589, 204, 53/581; 100/12, 27; 242/4 R, 4 B

[56] References Cited

U.S. PATENT DOCUMENTS

| | | | |
|---|---|---|---|
| 1,263,924 | 4/1918 | Pierce | 53/204 X |
| 1,387,016 | 8/1921 | Scherner | 53/204 X |
| 3,548,739 | 12/1970 | Glasson | 100/12 X |
| 4,230,519 | 10/1980 | DuBroff | 53/588 X |

FOREIGN PATENT DOCUMENTS

| | | | |
|---|---|---|---|
| 1332310 | 6/1963 | France | 53/204 |

*Primary Examiner*—John Sipos

*Attorney, Agent, or Firm*—Clifford A. Poff

[57] ABSTRACT

A generally O-shaped track extends through the central axial opening of a cylindrical object along the ends of a cylindrical object and along its outer cylindrical surface. A trolley moves along the track and carries a roll of strip wrapping material. As the trolley travels along the track and the strip material is paid off the roll, it is wrapped around the interior surface of the central opening, the ends of the cylindrical object, and its outer cylindrical surface as the cylindrical object itself is rotated about its axis. This produces successive, overlapping laps of strip material such that the entire cylindrical object is covered. Means are provided for maintaining the tension of strip material substantially constant as the trolley travels around the track.

11 Claims, 2 Drawing Sheets

APPARATUS FOR WRAPPING OVERLAPPING LAPS OF STRIP MATERIAL OVER A CYLINDRICAL OBJECT HAVING AN AXIAL OPENING THEREIN

BACKGROUND OF THE INVENTION

Field of the Invention

This invention relates to wrapping machines and, more particularly, to wrapping machines for wrapping stretch tape or the like around coils of metal strip material such that the tape is deposited on the coil in overlapping laps which extend through the central opening of the coil, then progress radially outwardly along one end surface of the coil, and then laterally along the outer surface of the coil, then radially inwardly to the central opening where the process is repeated. As tape is deposited onto the coil, the coil is rotated about its axis such that successive laps overlap each other. The tape is used to protect the coil of metal strip material in storage and during transport.

SUMMARY OF THE INVENTION

In accordance with the present invention, a generally O-shaped track extends through the central axial opening of a cylindrical object, along the ends of the cylindrical object and then along its outer cylindrical surface. A trolley moves along the track, the trolley carrying a roll of strip wrapping material, preferably a web of stretch plastic tape. Means are provided for maintaining the tension in the strip material substantially constant as the trolley travels around the track and the strip material is paid off the roll of strip material. The strip material is wrapped around the interior surface of the central opening, the ends of the cylindrical object, and its outer cylindrical surface as the cylindrical object itself is rotated about about its axis, thereby producing successive, overlapping laps of strip material until the entire cylindrical object is covered.

In the preferred embodiment of the invention, the aforesaid track is formed from two generally U-shaped halves hinged together at a point external to the cylindrical object. The U-shaped halves have free ends which meet or separate within the central axial opening to permit the track to be positioned in place for a wrapping operation or to be removed from the central opening in order that the wrapped coil can be removed from rolls which cause it to rotate. Strip material passes from the aforesaid roll of strip material and then around a tension-sensing roller. Means including the aforesaid roller are provided for sensing tension in the strip material and for controlling the speed of the trolley drive motor as the tension sensed varies, such that the speed of the drive motor for the trolley decreases as tension increases and increases as tension decreases.

In one embodiment of the invention shown herein, the means for sensing tension comprises an electrical strain gauge connected to the aforesaid tension roller. The strain gauge is electrically connected to a speed control circuit for the trolley drive motor such that the speed of the drive motor is varied as a function of the output of the aforesaid strain gauge to compensate for changes in tension.

Alternatively, the tension roller may be spring loaded or other means may be provided to insure that tension in the strip material is essentially constant at all times, regardless of whether the strip material is being applied to the cylindrical surfaces of the cylindrical object, its ends, or around edges between the cylindrical surfaces and end surfaces. In this way, a snugly fitting, tightly wapped covering is provided on the cylindrical object. Tension in the strip material must be sufficiently great to achieve a snug-fitting covering but, at the same time, cannot be great enough to sever the tape or strip material being applied.

DESCRIPTION OF THE DRAWINGS

The above and other objects and features of the invention will become apparent from the following detailed description taken in connection with the accompanying drawings which form a part of this specification and in which.

Figure 1:
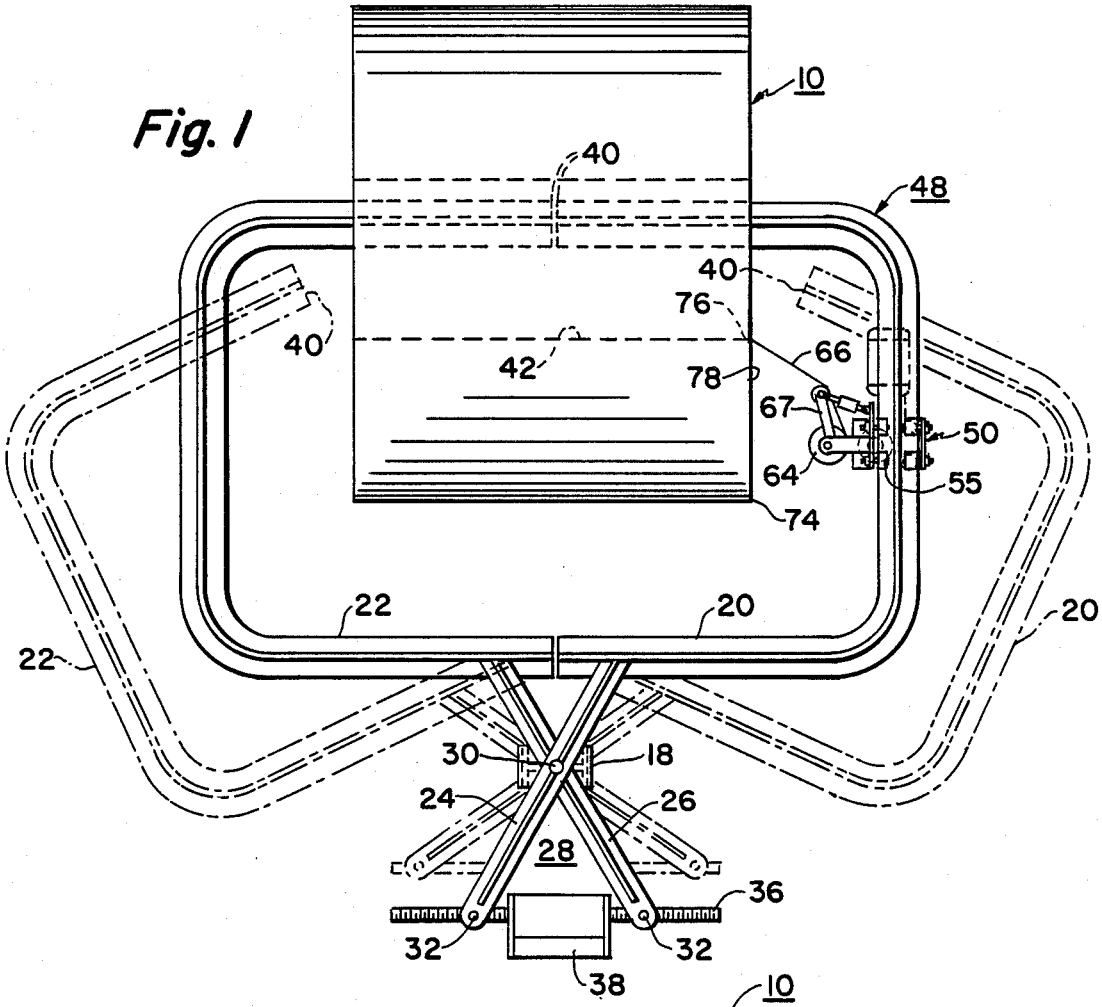
FIG. 1 is a top or plan view of the apparatus for wrapping strip material of the invention, showing the manner in which the track on which a trolley moves can be separated to permit insertion and removal of a cylindrical object to be wrapped.
Figure 2:
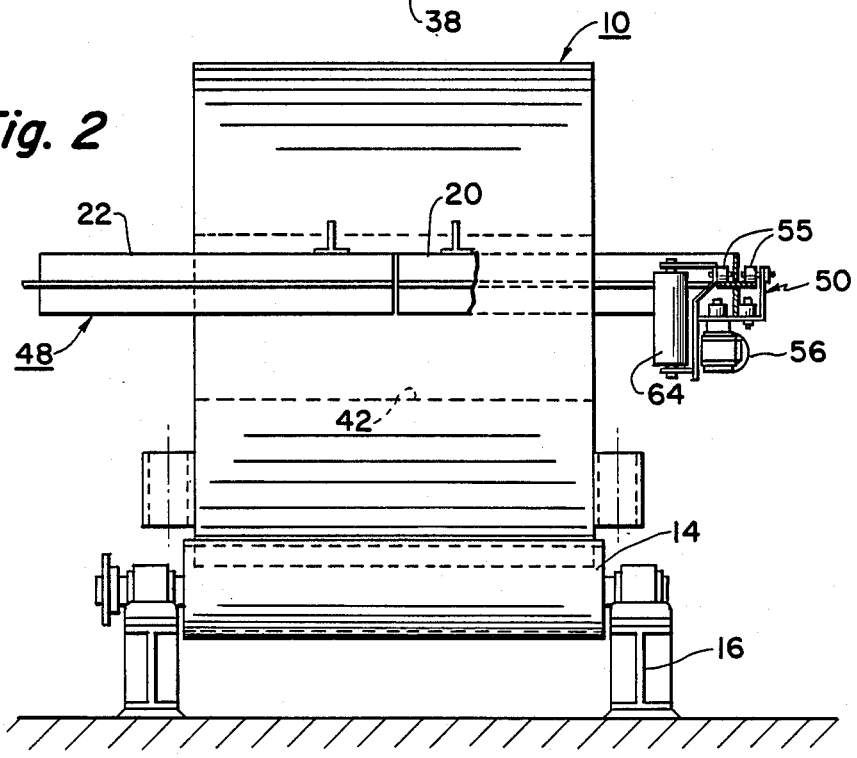
FIG. 2 is an end view of the apparatus shown in FIG. 1.
Figure 3:
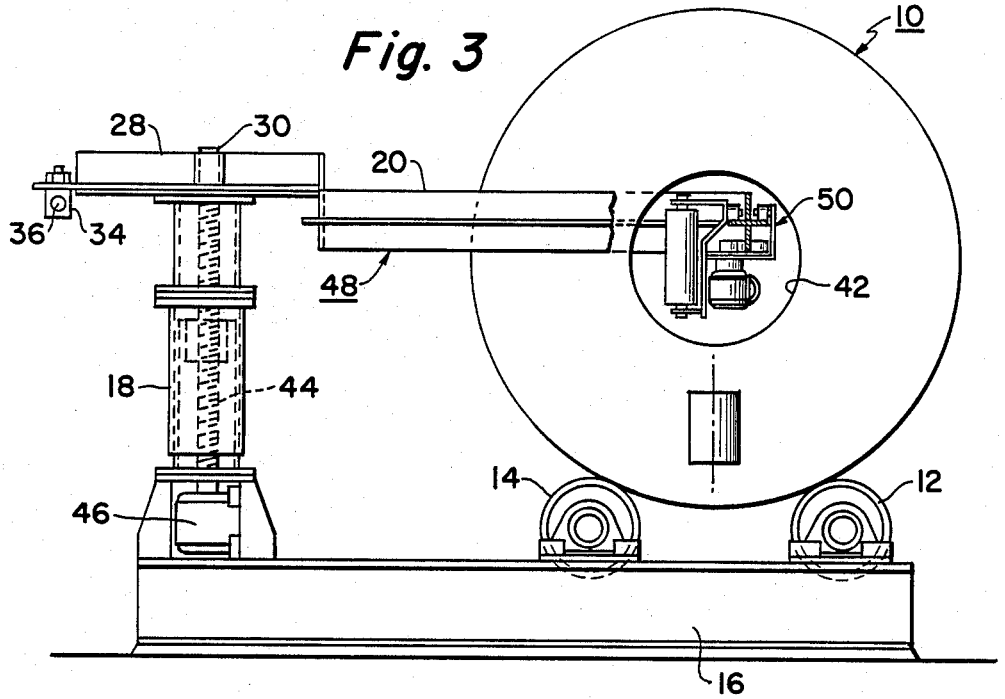
FIG. 3 is a side view of the apparatus shown in FIG. 1.

With reference now to the drawings, and particularly to FIGS. 1–3, there is shown a cylindrical object which, in the example given, comprises a coil of steel or other metallic strip material 10 which is deposited on a pair of drive rolls 12 and 14, the arrangement being such that when the rolls 12 and 14 are rotated in the same direction by suitable drive motors, not shown, the coil of strip material 10 will rotate also.

The rolls 12 and 14 are mounted on an I-beam base 16 which also carries an adjustable, upstanding column 18 (FIG. 3). The upper end of the column 18, is perhaps best shown in FIG. 1, carries a pair of generally U-shaped track segments 20 and 22. Each track segment 20 or 22 is carried on one end of the two legs 24 and 26 of a scissors arrangement 28. The two legs 24 and 26 are pivotally mounted on the upstanding column 18 as at 30, substantially midway between their ends. The ends of the scissors legs 24 and 26, opposite their connections to the U-shaped track segments 20 and 22, are pivotally connected at 32 to nuts 34 carried on a screw 36. Screw 36, in turn, is driven by means of a drive motor 38, the arrangement being such that as the drive motor 38 turns in one direction, the outer ends of the legs 24 and 26 will move together to position the track segments 20 and 22 in the full line position shown in FIG. 1; whereas, when the drive motor 38 turns in the opposite direction, the outer ends of legs 24 and 26 will tend to separate, thereby moving the U-shaped track segments to the dotted line positions shown in FIG. 1. With this arrangement, the free ends 40 of the track segments can be moved into or out of the central, axial opening 42 of the coil 10.

When the track segments 20 and 22 are rotated to the dotted line positions shown in Figure 1, the coil 10 can be removed from or inserted onto rolls 12 and 14. In order to lower a coil onto the apparatus, it is initially deposited onto the rolls 12 and 14 with track segments 20 and 22 separated. The track segments 20 and 22 are thereafter rotated such that their free ends 40 meet within the interior of the central opening 42 of the coil 10. As shown in FIG. 3, the column 18 is mounted on a screw 44 which is driven by a drive motor 46 such that the height of the track segments 20 and 22 can be adjusted for coils of different diameters.

Figure 4:
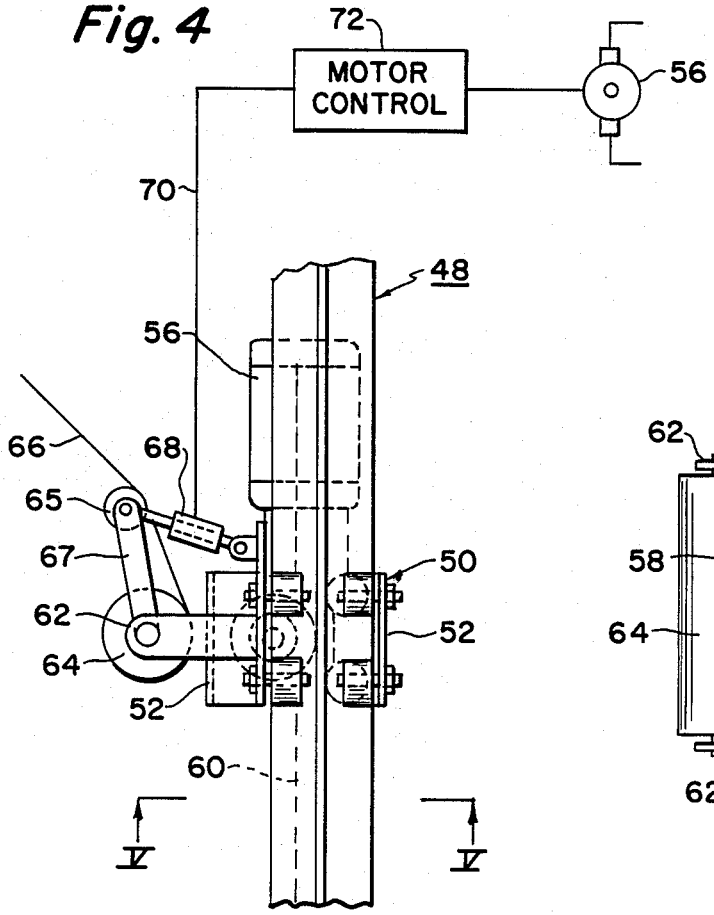
FIG. 4 is an enlarged sectional view of the track used in the apparatus of FIGS. 1–3, showing the trolley and roll of stretch plastic which is wrapped on the cylindrical object.
Figure 5:
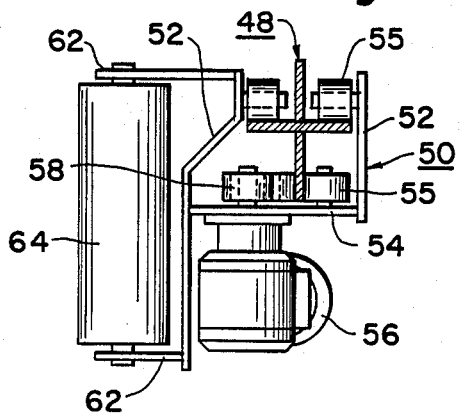
FIG. 5 is an end view of the enlarged trolley configuration shown in FIG. 4.

When the free ends 40 of the track segments 20 and 22 meet in the interior of the central opening 42 of the coil 10, they form a generally O-shaped track 48. Mounted on the track 48 (FIG. 1) is a motor-driven trolley 50, the details of which are best shown in FIGS. 4 and 5. The track 48, formed of segments 20 and 22, has a cross-section in the form of a cross as shown in FIG. 5. Trolley 50, itself, comprises a frame having side members 52 and a lower horizontal cross member 54 mounted on the track by rollers 55. Carried on the cross member 54 is a drive motor 56 (FIG. 5) connected through gear 58 to a rack 60 on the vertical upright member of the track 48, the arrangement being such that as the motor 56 rotates, trolley 50 will move around the track progressing, for example, from the central opeing 42 of the coil, then radially outwardly along its right side surface, then along its outer cylindrical surface, and then radially inwardly along its left side surface to the interior of the opening 42 where the process is repeated.

Carried on the upstanding inner side member 52 of the trolley 50 by means of brackets 62 is a roll of wrapping material 64. The wrapping material, which issues as a strip 66 as it is paid off from the roll 64 as shown in FIGS. 1 and 4, is preferably a stretch plastic material which will provide a taught wrapping on the coil 10. The strip 66, after issuing from the roll 64, passes around a tension roller 65 connected through a linkage and strain gauge 68 to the side 52 of the trolley 50. Tension roller is carried on an arm 67 pivotally connected to the brackets 62. The strain gauge 68, in turn, in connected through electrical connection 70 to a motor control circuit 72 which controls the trolley drive motor 56. It will be appreciated that as the trolley 50 passes around the track 48, the tension in the issuing strip material 66 will vary, being greatest as it passes around the edges 74 and 76 at the juncture of the outer and inner cylindrical surfaces of the coil 10 with its side surfaces 78 and will tend to be less as it passes along the side surfaces 78 and the inner and outer cylindrical surfaces of the coil 10. This change in tension is sensed by the strain gauge 68 which, in turn, varies the speed of trolley drive motor 66 through motor control circuit 72. Thus, as the strip material is wound around the edges 74 and 76, for example, the speed of the trolley drive motor 56 wil be decreased; and as the strip material 64 is deposited on the side 78 and the inner and outer cylindrical surfaces of the coil 10, the speed of the trolley drive motor will be increased, thereby maintaining substantially constant tension in the web of stretch plastic strip material 66. At the same time that the trolley 50 is traveling along the track 48, the rolls 12 and 14 will be driven to slowly rotate the coil 10. In this manner, successive laps of strip material 46 will be deposited onto the coil until the coil is completely covered. At this time, the strip material 64 is severed, its end is secured to the wrapped coil 10, and the U-shaped track segments 20 and 22 are moved into the dotted line position shown in FIG. 1 to permit removal of the coil 10 from the rolls 12 and 14. A new coil is then deposited on the rolls 12 and 14; track segments 20 and 22 are moved from the dotted line to the full line positions shown in FIG. 1; and the wrapping process is repeated for a new coil.

Instead of using a speed control system for the drive motor 56, it will be appreciated that tension roller 66 shown in FIG. 4 can be spring loaded; or other means can be utilized to maintain a substantially constant tension in the strip material 66 as it is being wrapped onto the coil 10.

Although the invention has been shown in connection with a certain specific embodiment, it will be readily apparent to those skilled in the art that various changes in form and arrangement of parts may be made to suit requirements without departing from the spirit and scope of the invention.

I claim:

1. Apparatus for wrapping strip material over the surfaces of a cylindrical object having a central axial opening extending therethrough, said apparatus comprising a generally O-shaped track including an extention extending through said central opening, and portions extending along the ends of the cylindrical object and along its outer cylindrical surface, said track being formed from two generally U-shaped halves hinged together at a point external to the cylindrical object and having free ends which can meet or separate within said central axial opening, a trolley moveable along said track, said trolley having a length in the direction of said track extension appreciably shorter than that of said track extension, a roll of strip wrapping material carried by said trolley, a drive motor for said trolley, and means for maintaining the tension in said strip material substantially constant as said trolley travels around said track and strip material is paid off said roll of strip material and the strip material is wrapped around the surface of said central opening, the ends of the cylindrical object and its outer cylindrical surface.

2. The apparatus of claim 1 wherein said cylindrical object is mounted on rolls rotatable about axes extending parallel to the axis of the cylindrical object, and means for rotating said rolls to rotate said cylindrical object as said trolley and roll of strip material travel along said track, whereby the strip material is deposited on the cylindrical object in overlapping laps.

3. The apparatus of claim 1 wherein the trolley carries the roll of strip material through said central axial opening and around the external surfaces of the said cylindrical object progressing radially outwardly to the outer circumference, then laterally along the outer surface of the cylindrical object parallel to its axis, and then radially inwardly to the central opening of the cylindrical object at which point the process is repeated.

4. The apparatus of claim 1 wherein said strip material passes from said roll of strip material and then around a tension roller.

5. The apparatus of claim 4 including means for sensing tension in said strip material, and means for controlling the speed of said trolley drive motor as the tension sensed varies.

6. The apparatus of claim 5 wherein the speed of said drive motor decreases as tension increases and increases as tension decreases.

7. The apparatus of claim 5 wherein the means for sensing tension comprises an electrical strain gauge connected to said tension roller, a speed control circuit for said trolley drive motor, and means electrically connecting said strain gauge to said speed control circuit.

8. The apparatus of claim 4 wherein said tension roller is spring-loaded to maintain tension in said strip material.

9. The apparatus of claim 1 wherein said cylindrical object has a flat surface portion extending parallel to said central opening, said track having a portion extending parallel to said flat surface portion beyond the opposite ends of said cylindrical object.

10. The apparatus of claim 9 wherein said track includes a support portion of said trolley having a first and second hemispheric path of travel, said trolley including means for maintaining contact with said support portion during said hemispheric travel with respect to a first and second direction, the first being the direction of a gravitational force, the second the direction of a lateral force coincident to the path of travel of said trolley.

11. The apparatus of claim 9 wherein said path of travel is arranged in a substantially horizontal plane and said means for maintaining contact with reference to said first direction comprises a first and second co-axially arranged roller means and with reference to said second direction a third roller means having its axis arranged substantially perpendicular to said horizontal plane.

* * * * *